US009017598B2

(12) United States Patent
Menchhofer et al.

(10) Patent No.: US 9,017,598 B2
(45) Date of Patent: Apr. 28, 2015

(54) METAL-BONDED GRAPHITE FOAM COMPOSITES

(75) Inventors: Paul A. Menchhofer, Clinton, TN (US); James W. Klett, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 389 days.

(21) Appl. No.: 13/528,929

(22) Filed: Jun. 21, 2012

(65) Prior Publication Data

US 2013/0195708 A1 Aug. 1, 2013

Related U.S. Application Data

(60) Provisional application No. 61/591,573, filed on Jan. 27, 2012.

(51) Int. Cl.
*B22F 3/14* (2006.01)
*C22C 32/00* (2006.01)

(52) U.S. Cl.
CPC ..... *C22C 32/0084* (2013.01); *B22F 3/14* (2013.01)

(58) Field of Classification Search
CPC ..... B22F 3/14; C22C 32/0084
USPC ..... 419/11, 66; 75/228; 423/448
See application file for complete search history.

(56) References Cited

U.S. PATENT DOCUMENTS 3,345,440 A 10/1967 Googin et al.
5,282,861 A 2/1994 Kaplan
5,626,977 A * 5/1997 Mayer et al. ..... 429/523
5,932,185 A * 8/1999 Pekala et al. ..... 423/445 R
6,033,506 A 3/2000 Klett
6,037,032 A 3/2000 Klett et al.
6,248,286 B1 6/2001 Lauf et al.
6,261,485 B1 7/2001 Klett
6,287,375 B1 9/2001 Klett
6,344,159 B1 2/2002 Klett
6,387,343 B1 5/2002 Klett
6,398,994 B1 6/2002 Klett
6,399,149 B1 6/2002 Klett et al.
6,430,935 B1 8/2002 Klett et al.
6,656,443 B2 12/2003 Klett
6,663,842 B2 12/2003 Klett
6,673,328 B1 1/2004 Klett et al.
6,706,239 B2 3/2004 Haack et al.
6,780,505 B1 8/2004 Klett et al.
6,809,304 B2 10/2004 Besmann et al.
6,860,910 B2 3/2005 Rogers et al.
6,869,455 B2 3/2005 Rogers et al.
7,014,151 B2 3/2006 Klett
7,070,755 B2 7/2006 Klett et al.
7,147,214 B2 12/2006 Klett et al.
7,157,019 B2 1/2007 Klett et al.
7,166,237 B2 1/2007 Klett et al.
7,452,389 B2 11/2008 Rogers et al.

(Continued)

OTHER PUBLICATIONS

Sing et al.; "Integration of High-Conductivity Graphite Foam to Metallic Systems Using Ag—Cu—Ti and Ag—Cu—Pd Braze Alloys"; Int. J. Ceram. Technol., vol. 10 No. 5; pp. 790-800; 2013; no month available.*

(Continued)

*Primary Examiner* — Helene Klemanski
(74) *Attorney, Agent, or Firm* — Joseph A. Marasco

(57) ABSTRACT

A metal-bonded graphite foam composite includes a ductile metal continuous phase and a dispersed phase that includes graphite foam particles.

18 Claims, 4 Drawing Sheets

(56) References Cited

U.S. PATENT DOCUMENTS

| | | | | |
|---|---|---|---|---|
| 7,481,855 | B2 | 1/2009 | Rogers et al. | |
| 7,648,735 | B2 | 1/2010 | Hunter et al. | |
| 7,670,682 | B2 | 3/2010 | Klett et al. | |
| 7,960,656 | B2 | 6/2011 | Matviya | |
| 2002/0023858 | A1 | 2/2002 | Klett | |
| 2003/0064216 | A1* | 4/2003 | Tobita et al. | 423/449.1 |
| 2003/0115753 | A1 | 6/2003 | Klett et al. | |
| 2003/0162007 | A1 | 8/2003 | Klett et al. | |
| 2006/0014908 | A1* | 1/2006 | Rotermund et al. | 525/452 |
| 2007/0281116 | A1 | 12/2007 | Matviya et al. | |
| 2008/0166492 | A1 | 7/2008 | Lu et al. | |
| 2009/0049871 | A1 | 2/2009 | Klett et al. | |
| 2009/0136809 | A1* | 5/2009 | Wang | 429/27 |
| 2010/0139823 | A1 | 6/2010 | Gash et al. | |
| 2010/0186422 | A1 | 7/2010 | Yang et al. | |
| 2010/0264358 | A1* | 10/2010 | Mack et al. | 252/62.55 |
| 2011/0111251 | A1* | 5/2011 | Evans | 419/66 |

OTHER PUBLICATIONS

Singh, Mrityunjay, Bonding and Integration of Graphite Foams to Metallic Systems for Thermal Management Applications.

Klett, James, High Thermal Conductivity, Mesophase Pitch-Derived Carbon Foams, Powerpoint Presentation.

Hutsch, Innovative Metal-Graphite Composites as Thermally Conducting Materials, PM2010 World Congress—PM Functional Materials—Heat Sinks.

Lambert, Thermal Conductivity of Graphite/Aluminum and Graphite/Copper Composites, Journal of Heat Transfer, May 1996.

Pyrolytic Graphite Sheet, The Future of Thermal Management, www.panasonic.com/pgs.

* cited by examiner

METAL-BONDED GRAPHITE FOAM COMPOSITES

CROSS REFERENCE TO RELATED APPLICATION

This application claims priority to U.S. Provisional Patent Application No. 61/591,573 filed on Jan. 27, 2012, which is incorporated herein in its entirety by reference.

STATEMENT REGARDING FEDERALLY SPONSORED RESEARCH

The United States Government has rights in this invention pursuant to contract no. DE-AC05-00OR22725 between the United States Department of Energy and UT-Battelle, LLC.

BACKGROUND OF THE INVENTION

Graphite foam technology developed at Oak Ridge National laboratory (ORNL) has clearly demonstrated remarkable thermal properties performance when compared to other more commonly used materials, such as aluminum, copper, and other metals. Graphite foam has found applications in a broadening array of useful products such as heat sinks, heat exchangers, brake disc components, clutch components, friction drives, motor brushes, Peltier devices, i.e. thermal cyclers, and others, for example. However, the relatively low mechanical properties thereof have proven impractical for some applications. In order to improve the mechanical properties, there have been a variety of efforts to infiltrate monolithic graphite foam substrates with metals and epoxies to render a finished product with improved structural integrity as well as excellent thermal conductivity.

The following U.S. patents and U.S. patent application publications are specifically referenced and incorporated herein in their entirety by reference: U.S. Pat. No. 6,033,506 entitled "Process for Making Carbon Foam" issued to James W. Klett on Mar. 7, 2000; U.S. Pat. No. 6,037,032 entitled "Pitch-Based Carbon Foam Heat Sink with Phase Change Material" issued to James W. Klett, et al. on Mar. 14, 2000; U.S. Pat. No. 6,248,286 entitled "Method of Making a Functionally Graded Material" issued to Robert J. Lauf, et al. on Jun. 19, 2001; U.S. Pat. No. 6,261,485 entitled "Pitch-Based Carbon Foam And Composites" issued to James W. Klett on Jul. 17, 2001; U.S. Pat. No. 6,287,375 entitled "Pitch Based Foam with Particulate" issued to James W. Klett on Sep. 11, 2001; U.S. Pat. No. 6,344,159 entitled "Method for Extruding Pitch Based Foam" issued to James W. Klett on Feb. 5, 2002; U.S. Pat. No. 6,387,343 entitled "Pitch-Based Carbon Foam and Composites" issued to James W. Klett on May 14, 2002; U.S. Pat. No. 6,398,994 entitled "Method of Casting Pitch Based Foam" issued to James W. Klett on Jun. 4, 2002; U.S. Pat. No. 6,399,149 entitled "Pitch-Based Carbon Foam Heat Sink with Phase Change Material" issued to James W. Klett, et al. on Jun. 4, 2002; U.S. Pat. No. 6,430,935 entitled "Personal Cooling Air Filtering Device" issued to James W. Klett, et al. on Aug. 13, 2002; U.S. Pat. No. 6,656,443 entitled "Pitch-Based Carbon Foam and Composites" issued to James W. Klett on Dec. 2, 2003; U.S. Pat. No. 6,663,842 entitled "Pitch-Based Carbon Foam and Composites" issued to James W. Klett on Dec. 16, 2003; U.S. Pat. No. 6,673,328 entitled "Pitch-Based Carbon Foam and Composites and Uses Thereof" issued to James W. Klett, at al. on Jan. 6, 2004; U.S. Pat. No. 6,780,505 entitled "Pitch-Based Carbon Foam Heat Sink with Phase Change Material" issued to James W. Klett, et al. on Aug. 24, 2004; U.S. Pat. No. 6,809,304 entitled "High Efficiency, Oxidation Resistant Radio Frequency Susceptor" issued to Theodore M. Besmann, et al. on Oct. 26, 2004; U.S. Pat. No. 7,014,151 entitled "Pitch-Based Carbon Foam Heat Sink with Phase Change Material" issued to James W. Klett on Mar. 21, 2006; U.S. Pat. No. 7,070,755 entitled "Pitch-Based Carbon Foam and Composites and Use Thereof" issued to James W. Klett, et al. on Jul. 4, 2006; U.S. Pat. No. 7,147,214 entitled "Humidifier for Fuel Cell Using High Conductivity Carbon Foam" issued to James W. Klett, et al. on Dec. 12, 2006; U.S. Pat. No. 7,157,019 entitled "Pitch-Based Carbon Foam Heat Sink with Phase Change Material" issued to James W. Klett, et al. on Jan. 2, 2007; U.S. Pat. No. 7,166,237 entitled "Pitch-Based Carbon Foam Heat Sink with Phase Change Material" issued to James W. Klett, et al. on Jan. 23, 2007; U.S. Pat. No. 7,670,682 entitled "Method and Apparatus for Producing a Carbon Based Foam Article Having a Desired Thermal-Conductivity Gradient" issued to James W. Klett, et al. on Mar. 2, 2010; U.S. Patent Application Publication No. 20020023858 entitled "Pitch Based Foam and Apparatus for Extruding Pitch Based Foam" filed by James W. Klett on Feb. 28, 2002; U.S. Patent Application Publication No. 20030115753 entitled "Pitch-Based Carbon Foam Heat Sink with Phase Change Material" filed by James W. Klett, et al. on Jun. 26, 2003; U.S. Patent Application Publication No. 20030162007 entitled "Energy Converting Article and Method Of Making" filed by James W. Klett, et al. on Aug. 28, 2003; U.S. Patent Application Publication No. 20090049871 entitled "Thermal Control Structure and Garment" filed by James W. Klett, et al. on Feb. 26, 2009; and U.S. Patent Application Publication No. 20100186422 entitled "Efficient and Light Weight Thermoelectric Waste Heat Recovery System" filed by Jihui Yang, et al. on Jul. 29, 2010.

BRIEF SUMMARY OF THE INVENTION

A metal-bonded graphite foam composite includes a ductile metal continuous phase and a dispersed phase that includes graphite foam particles.

A method of making a metal-bonded graphite foam composite includes the steps of: grinding graphite foam into a powder; mixing the graphite foam powder with a ductile metal powder to form a mixture; and consolidating the mixture to form a metal-bonded graphite foam composite.

DETAILED DESCRIPTION OF THE INVENTION

The present invention exploits the high thermal conductivity of the graphite foam while creating a new lightweight metallic/graphitic composite.

Figure 1:
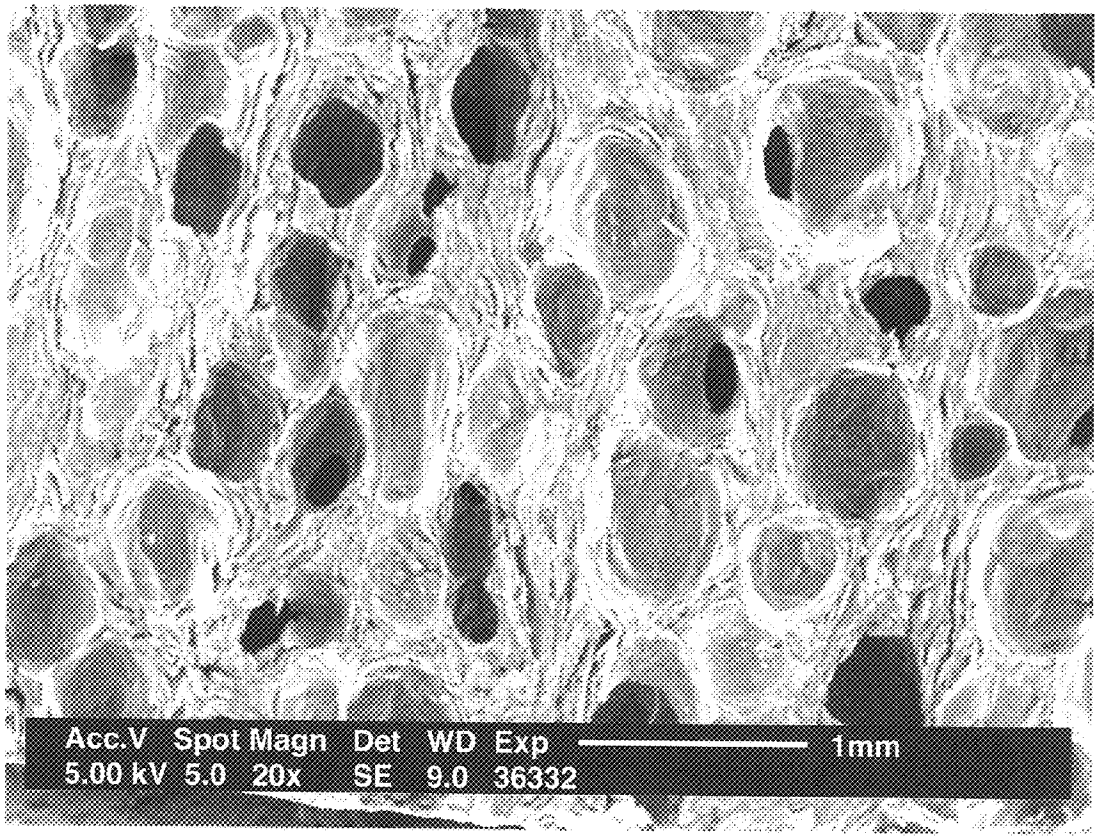
FIG. 1 is a micrograph of graphite foam.

Attempts to use a method of metal-infilling an as-fabricated foam monolith were not successful because molten aluminum would not readily wet graphite, which is necessary for significant infiltration. The porosity within the foam architecture is highly circuitous, and is not always connected, as shown in FIG. 1. Moreover, it was found to be very difficult to control the volume fractions of metal and graphite when attempting to in-fill monolithic foams.

The crystalline structure of graphite foam ligaments are distinctly unique in morphology because of the crystalline arrangement developed as a direct result of the foaming process. It was discovered that crushed and/or ground graphitized foam particles are distinctly unique in morphology. As globular graphite shells are crushed and broken in the grinding process, the resulting fractured, ligamentous particles have a unique curvature, directly attributable to the globular origins thereof. The terms "ligament" and derivatives thereof, "particle" and derivatives thereof, and "powder" and derivatives thereof are used interchangeably hereinafter.

The first step in carrying out examples of the present invention is to first crush or grind graphite foam into a particulate form of a desired particle size or range of sizes. Typical particle sizes may range from 1-1000 μm, for example, but can be tailored to suit the needs of a particular composite of choice. For example, as graphite foam powder particle size is reduced, relative surface area thereof increases and thus provides better heat transfer between metal component and foam component, and thus throughout the composite.

The particulate graphite foam can be combined in various proportions with various metal powders followed by consolidation by a conventional method such as vacuum hot-pressing, for example.

Alternatively, particulate graphite foam and ductile metal powder mixtures can be roll-compacted into a sheet and subsequently hot pressed, or may be cold forged, hot-forged, cold-pressed, isostatically pressed, or formed into shapes by any of various other, known powder metallurgy methods.

Figure 2:
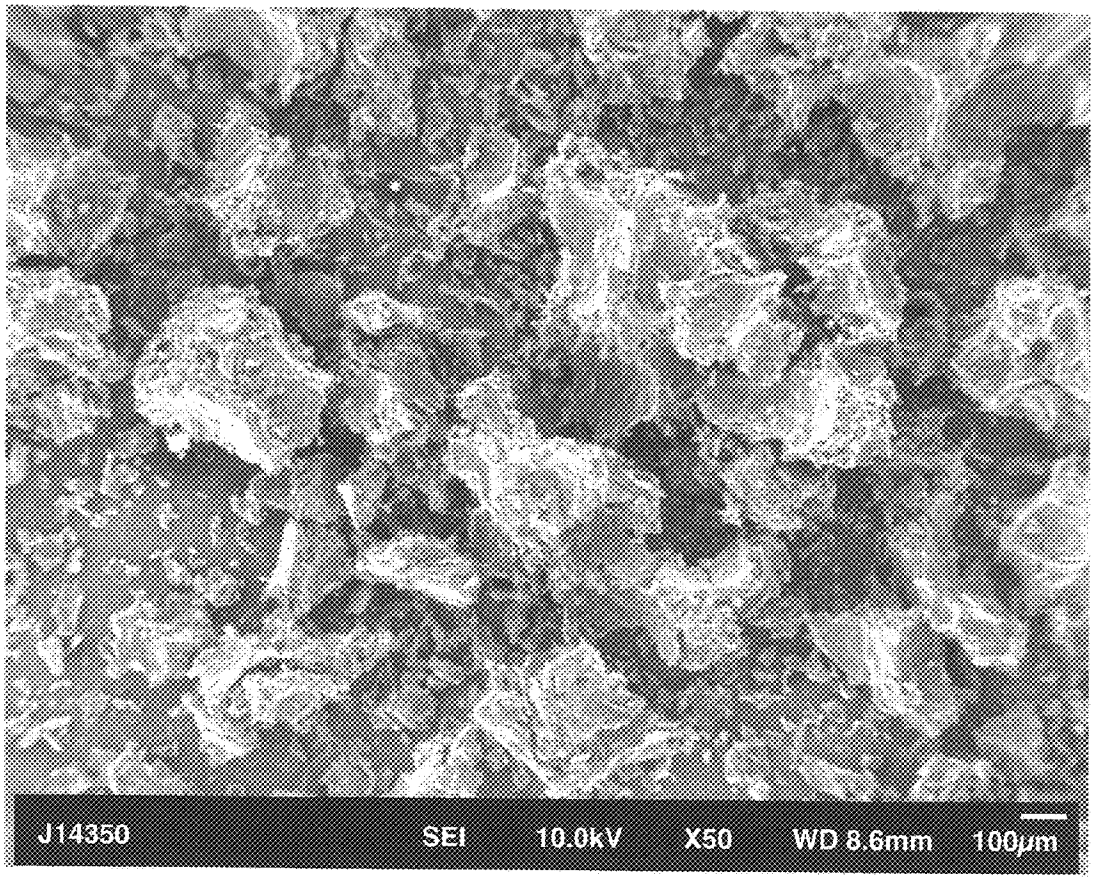
FIG. 2 is a micrograph of ground graphite foam particles.

The new composite captures a significant amount of the lightweight, high-conductivity foam ligaments, for example, those shown in FIG. 2, that are bonded in a matrix of metal. The composite thus formed combines the structural integrity and other beneficial properties of metal with the extremely high thermal conductivity of the graphite foam ligaments. The present invention specifically utilizes the ground graphite foam ligaments, which is distinct from simply adding ground graphite powder, which is different in morphology.

Moreover, and particularly unique to this approach, is the fact that the graphite foam ligaments undergo an increase in relative density during hot-pressing as compared to either the as-fabricated foam, or a typical graphite powder.

Moreover, to maximize thermal conductivity performance, the composite material can easily be tailored to contain a higher mass (relative to volume) of the thermally conductive graphitic foam ligaments than it would if infiltrated in the open "as-foamed" structure, which would necessarily contain a much higher volume fraction of metal due to the open structure and low relative density of the particulate graphite foam.

As the graphite foam is ground to a powder, the relative surface area of the graphite increases, and further aids in heat transfer between the bonding metal/s and the foam in the final composite.

Figure 3:
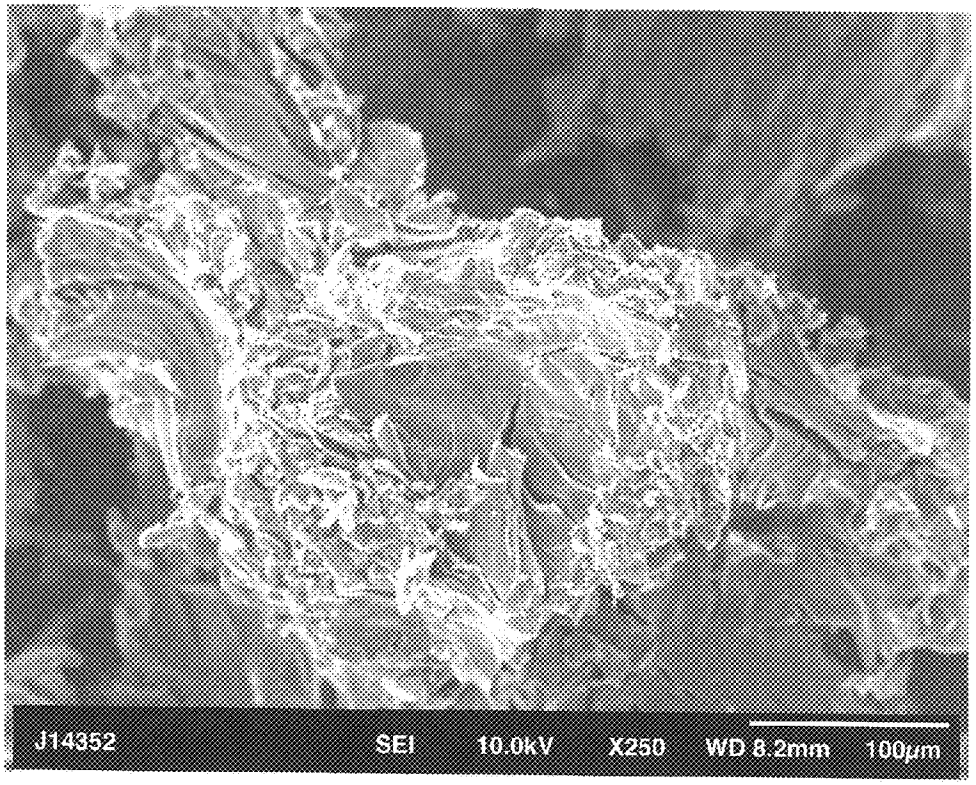
FIG. 3 is a high-magnification micrograph of a ground graphite foam particle.

Graphite foam in the foamed state is comprised of very high thermally conductive graphitic ligaments that form largely spherical pores shaped by graphitic layers, as shown in FIG. 1. By crushing and altering the bulk morphology of the existing foam into discrete and uniquely shaped particles of ligamentous graphite, as shown in FIGS. 2, 3, a higher surface area (relative to mass) of thermally conductive powder is created. This increased surface area powder, when in contact with metal in hot-pressed and densified composites, dramatically increases the heat transfer between the two materials and ultimately throughout the material.

In addition to serving as a bonding agent between the graphitic ground foam particles, the metal imparts characteristics thereof, i.e. structural and mechanical properties to the composite. Mechanical properties can be largely dependent on the volume fraction of metal and/or optional mechanical strengthening additives in the composite.

Composites of metal and ground graphite foam particles may be blended and tailored for varying applications by varying the volume fractions of the constituents. For example, the volume fraction of graphite foam particles can be in the range of 10% to 90%, 25% to 80%, 35% to 75%, 45% to 75%, 55% to 75% or any value within the foregoing ranges.

The ductile metal continuous phase can be at least one of the following: aluminum, titanium, steel, stainless steel, iron, nickel, copper, bronze, brass, alloy compositions including any of the foregoing, and mixtures including any of the foregoing. The skilled artisan will recognize that processing conditions, such as temperature, pressure, and duration, for example, can be optimized for any particular ductile metal in accordance with the well-known characteristics of the same. Metals that undergo exothermic reactions with the graphite at the pressing temperature may not be suitable for the present invention.

Other additives such as, for example, carbon (including graphene, graphite, nanotubes, fullerenes, and the like), ceramic, metal, glass, mineral (including natural rock, synthetic minerals, and the like), or combinations of any of the foregoing can be added for enhanced mechanical, structural, electrical, or other desirable properties. Additives can be in the form of, for example, amorphous particles, random-shaped particles, rounded particles, crystals, whiskers, needles, fibers, tubes, or combinations of any of the foregoing.

For example, addition of Sic particles can serve several functions. Since the hardness of SiC is higher than that of titanium or graphite, such an addition would serve to raise the surface hardness and increase resistance to scratching, wear, and other mechanical damage. Moreover, SiC addition can change the friction behavior and possibly increase the friction to a point to be useful in braking applications. Moreover, SiC has useful thermal properties, >150 W/mK, compared to most ceramic components that could serve the foregoing functions, SiC additive yields a composite with higher thermal conductivities than conventional friction components such as cast Iron, for example.

Moreover, the material of the present invention can be bonded to sundry metal substrates by conventional soldering, brazing and/or welding methods. The capability of bonding represents a significant improvement over conventional graphite foam materials.

Composite materials of the present invention exhibit improved mechanical properties over graphite foam products while maintaining very high thermal conductivity, with low mass, high electrical conductivity. Applications for the present invention can be very broad for heat transfer technologies.

For example, for applications having temperatures up to approximately 450° C. in air, the present invention may be applied to sundry types of heat-sink materials where rapid conduction or where large amounts of heat need to be removed. For higher temperature applications where oxygen is not present, the skilled artisan will recognize that nickel, titanium, copper, and the like, and alloys comprising any of the foregoing may be used.

Due to the enhanced density of the compacted composite coupled with very high thermal conductivity, the present invention enables the decrease in the physical sizes of heat sink devices, thus miniaturizing the device or creating better or improved efficiencies. For computing applications where miniaturization is a key goal, this higher efficiency material may be advantageous. The composites are suitable for diverse applications such as, for example, industrial heating and cooling exchange systems, air conditioning and cooling, electronics components, printed circuit boards, high intensity lighting, automotive, aerospace, Peltier devices, and thermal cyclers, moreover, the composites are suitable for integration into sundry engineered products where mitigation of excess heat is needed.

A method of making a metal-bonded graphite foam composite comprises the steps of: grinding graphite foam into a powder; mixing the graphite foam powder with a ductile metal powder; and hot pressing the mixture to form a metal-bonded graphite foam composite. The mixture can also be roll compacted into a sheet prior to hot pressing, or may be cold forged, hot-forged, or cold-pressed, isostatically pressed, or formed into shapes by other known powder metallurgy means.

The processing conditions will vary depending on the composition of the ductile metal. Metals which react with graphite at the pressing temperature could potentially be used in carrying out the present invention when the goal is to achieve interfacial reaction layers for improved bonding between the differing composite ingredients. (Reaction layers could impede the metal to graphite foam heat transfer however and would have to be evaluated for any given composition, and is beyond the scope of this disclosure.)

Moreover, the ratio of metal powder to ground graphite foam can be varied, either by steps or continuously within the composite. Such variation results in a functionally graded composite, also called a functionally graded material (FGM), which can be used to exploit the high conductivity of a high volume percentage of ground graphite on one side to a high volume percentage of metal on an opposite face (for example). Methods of making FGM are described in U.S. Pat. No. 6,248,286, referenced herein above. Functionally graded composites in accordance with examples of the present invention are desirable in certain applications where high tensile and/or other mechanical stresses are mitigated on one side—and where the need for heat removal exists on the other side. Examples of such an application include heat exchanger tubes, brake components and clutch components.

Figure 4:
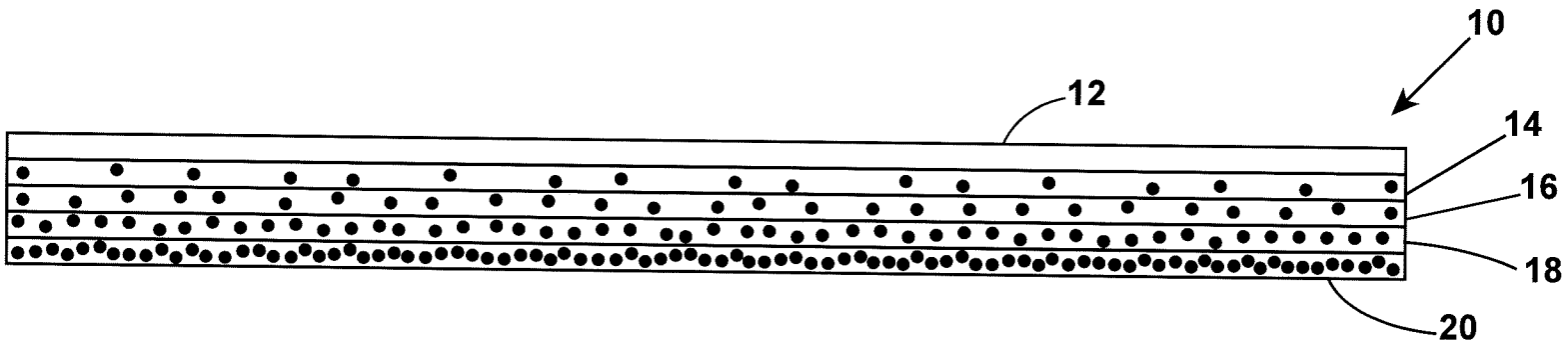
FIG. 4 is a schematic diagram of a functionally graded article in accordance with examples of the present invention For a better understanding of the present invention, together with other and further objects, advantages and capabilities thereof, reference is made to the following disclosure and appended claims in connection with the above-described drawings.

FIG. 4 is a schematic diagram of a functionally graded article 10 in accordance with examples of the present invention, comprising five contiguous regions 12, 14, 16, 18, 20. The first region 12 comprises 100% metal and 0% ground graphite foam particles, and can function as a cladding in some examples of the present invention. The second region 14 comprises 80% metal and 20% ground graphite foam particles. The third region 16 comprises 60% metal and 40% ground graphite foam particles. The fourth region 18 comprises 40% metal and 60% ground graphite foam particles. The fifth region 20 comprises 20% metal and 80% ground graphite foam particles. There can be fewer or more layers with varying components. The first layer does not have to be 100% metal; it can contain some ground graphite foam particles as desired. There may be composite layers of metal and foam clad in 100% metal layers in order to protect the composite or to provide desired properties such as weldability, or strength, etc. Moreover, the regions can vary in three dimensions to create three-dimensional functional gradients.

In the relatively simple example shown in FIG. 4, one side of the functionally graded article 12 substantially comprises metal to facilitate weldability and/or to maintain the structural characteristics of the chosen alloy on the metal side, for example. The opposing side 20 comprises mostly ground foam for high thermal conductivity, and a small amount of metal phase to maintain structural integrity and strength. Such a functionally graded article is suitable for applications where it is necessary to weld the composite device to a surface of another such as where heat would be mitigated by the composite article.

EXAMPLE I

Koppers graphite foam (L-1), a trademarked product of Koppers, Inc., 436 Seventh Avenue, Pittsburgh, Pa. 15219, shown in FIG. 1, was ground to powder having a particle size range of 1-1000 μm as shown in FIGS. 2, 3 using standard ball milling techniques. Some Aluminum was obtained from Alfa Aesar, 26 Parkridge Rd., Ward Hill, Mass. 01835, and some Aluminum was obtained from Milleneum Materials, 642 Barbrow Lane, Knoxville, Tenn. 37932. SiC (−325 mesh), obtained from Hermann C. Starck Inc., 425 Park Ave., New York, N.Y. 10022, was included @ 25 weight %. Ti 6/4 (ASTM Grade 5, generally comprising 6% Al, 4% V, no more than 0.25% iron, no more than 0.2% O, Balance Ti) was obtained from Ametek/Reading Alloys, 220 Old West Penn Ave Robesonia, Pa. 19551.

Composite samples were prepared as described in Table 1. Aluminum based samples were hot-pressed into ingots at 600° C. at 5 KSI pressure for 30 minutes duration. Ti based samples were hot-pressed into ingots at 950-1000° C. at 5 KSI pressure for 30 minutes duration. TiC needles, used in one sample, had an average length of about 0.5 to 1 μm and an average aspect ratio of about 20:1 to 50:1.

TABLE 1

| Sample Id | Sample Composition (Wt. %) |
|---|---|
| PM-10-94-1 | 33% Al −325 mesh (Alfa 11067), 67% Ground Koppers L-1 |
| PM-10-94-2 | 47% Ti 6/4, 3% TiC needles, 50% Ground Koppers L-1 |
| PM-10-95-1 | 50% Ti 6/4, 50% Ground Koppers L-1 |
| PM-10-95-2 | 40% Ti 6/4, 60% Ground Koppers L-1 |
| PM-10-95-3 | 25% Al −325 mesh (Alfa 11067), 75% Ground Koppers L-1 |
| PM-10-95-4 | 70% Ti 6/4, 30% Ground Koppers L-1 |
| PM-10-95-5 | 100% Ti 6/4 (Control) |
| PM-10-96-1 | 100% Al −325 mesh (Millineum) (Control) |
| PM-10-96-2 | 50% Al −325 mesh (Millineum), 50% Ground Koppers L-1 |
| PM-10-96-3 | 25% Al −325 mesh (Millineum), 25% SiC −325 mesh, 50% Ground Koppers L-1 |
| PM-10-96-8 | 75% Al −325 mesh (Millineum), 25% Ground Koppers L-1 |

Samples were machined from the hot-pressed ingots and the properties and characteristics thereof were determined. Thermal diffusivity was measured with the Xenon flash method (ASTM# C714). Thermal conductivity was then calculated using the relationship: $k=arC_p$. (A constant value of $C_p$ of 709 J/kgK for solid carbon graphite was used); Note the lower values for both control samples (#3 for pure Al, and #10 for pure Ti). Strength was tested using ASTM methods. Strength measurements were made using ASTM# E-8 to determine average peak stress (KSI), average stress break (KSI), and maximum strain (%). Results are shown in Table 2.

TABLE 2

| SAMPLE ID | Thermal Diffusivity [cm2/sec] | Thermal Conductivity (W/mK) | Avg Peak Stress (KSI) | Avg Stress@ Break (KSI) | Max % Strain |
|---|---|---|---|---|---|
| PM-10-94-1 | 0.73 | 172.24 | — | — | — |
| PM-10-94-2 | 0.175 | 47.39 | — | — | — |
| PM-10-95-1 | 0.28 | 73.71 | 4 | 1.565 | 1.803 |
| PM-10-95-2 | 0.706 | 185.18 | — | — | — |
| PM-10-95-3 | — | 166.07 | — | — | — |
| PM-10-95-4 | 0.1102 | 28.78 | 10.33 | 9.915 | 1.4555 |
| PM-10-95-5 | 0.289 | 8.51 | — | — | — |
| PM-10-96-1 | 0.3949 | 98.28 | — | — | — |
| PM-10-96-2 | 0.88 | 212.57 | 1.74 | 1.37 | 1.4365 |
| PM-10-96-3 | 0.366 | 89.07 | — | — | — |
| PM-10-96-8 | — | — | 5.485 | 4.285 | 1.703 |

While there has been shown and described what are at present considered to be examples of the invention, it will be obvious to those skilled in the art that various changes and modifications can be prepared therein without departing from the scope of the inventions defined by the appended claims.

What is claimed is:

1. A metal-bonded graphite foam composite comprises: a continuous phase comprising a ductile metal; and a dispersed phase comprising graphite foam particles.

2. A metal-bonded graphite foam composite in accordance with claim 1, wherein said ductile metal comprises at least one of the group consisting of aluminum, titanium, steel, stainless steel, iron, nickel, copper, bronze, and brass.

3. A metal-bonded graphite foam composite in accordance with claim 1, wherein said composite comprises said graphite foam particles in a volume fraction in the range of 1% to 90%.

4. A metal-bonded graphite foam composite in accordance with claim 3, wherein said composite comprises said graphite foam particles in a volume fraction in the range of 10% to 80%.

5. A metal-bonded graphite foam composite in accordance with claim 4, wherein said composite comprises said graphite foam particles in a volume fraction in the range of 25% to 75%.

6. A metal-bonded graphite foam composite in accordance with claim 5, wherein said composite comprises said graphite foam particles in a volume fraction in the range of 35% to 75%.

7. A metal-bonded graphite foam composite in accordance with claim 6, wherein said composite comprises said graphite foam particles in a volume fraction in the range of 55% to 75%.

8. A metal-bonded graphite foam composite in accordance with claim 1 wherein said composite comprises said graphite foam particles in a volume fraction that varies through said composite in at least one direction to form a functionally graded composite.

9. A metal-bonded graphite foam composite in accordance with claim 1, further comprising at least one additive material.

10. A metal-bonded graphite foam composite in accordance with claim 9, wherein said at least one additive material comprises at least one material selected from the group consisting of: carbon, ceramic, metal, glass, and mineral.

11. A metal-bonded graphite foam composite in accordance with claim 10, wherein said material is characterized by at least one form selected from the group consisting of: amorphous particles, random-shaped particles, rounded particles, crystals, whiskers, needles, fibers, and tubes.

12. A method of making a metal-bonded graphite foam composite comprising:

a. providing ground graphite foam powder;

b. mixing said graphite foam powder with a ductile metal powder to form a mixture; and c. consolidating said mixture to form a metal-bonded graphite foam composite.

13. A method of making a metal-bonded graphite foam composite in accordance with claim 12, wherein said consolidating comprises hot pressing.

14. A method of making a metal-bonded graphite foam composite in accordance with claim 13, further comprising roll compacting said mixture into a sheet prior to said hot pressing.

15. A method of making a metal-bonded graphite foam composite in accordance with claim 12, further comprising varying a ratio of ductile metal powder to ground graphite foam through at least one dimension to form a functionally graded composite.

16. A method of making a metal-bonded graphite foam composite in accordance with claim 12, further comprising, before consolidating said mixture, adding to said mixture at least one additive material.

17. A method of making a metal-bonded graphite foam composite in accordance with claim 16, wherein said at least one additive material comprises at least one material selected from the group consisting of: carbon, ceramic, metal, glass, and mineral.

18. A method of making a metal-bonded graphite foam composite in accordance with claim 17, wherein said material is characterized by at least one form selected from the group consisting of: amorphous particles, random-shaped particles, rounded particles, crystals, whiskers, needles, fibers, and tubes.

* * * * *